US006637548B2

(12) United States Patent
Pass

(10) Patent No.: US 6,637,548 B2
(45) Date of Patent: Oct. 28, 2003

(54) PERSONAL STAND AND METHOD OF USING A PERSONAL STAND

(76) Inventor: Edward L. Pass, 1158 Stirling Dr., Danville, KY (US) 40402

( * ) Notice: Subject to any disclaimer, the term of this patent is extended or adjusted under 35 U.S.C. 154(b) by 0 days.

(21) Appl. No.: 10/135,275

(22) Filed: Apr. 30, 2002

(65) Prior Publication Data

US 2002/0121407 A1 Sep. 5, 2002

Related U.S. Application Data

(63) Continuation-in-part of application No. 09/571,220, filed on May 16, 2000, now abandoned.

(51) Int. Cl.[7] ..... E06C 7/16

(52) U.S. Cl. ..... 182/121; 182/120; 182/122; 248/210; 248/238

(58) Field of Search ..... 182/120, 121, 182/122, 123; 248/210, 235, 238

(56) References Cited

U.S. PATENT DOCUMENTS

| | | | | | |
|---|---|---|---|---|---|
| 446,682 | A | * | 2/1891 | Holmes | 182/121 |
| 686,159 | A | * | 11/1901 | Sprague | 182/121 |
| 745,750 | A | * | 12/1903 | Ziegler et al. | 182/121 X |
| 2,419,727 | A | * | 4/1947 | Picone | 182/121 X |
| 2,432,206 | A | * | 12/1947 | Mott | 182/121 |
| 2,709,626 | A | * | 5/1955 | Woddburn | 182/121 X |
| 2,801,886 | A | * | 8/1957 | Peterson | 182/121 |
| 2,984,446 | A | * | 5/1961 | Richter | 182/121 |
| 3,331,577 | A | * | 7/1967 | Grunwaldt | 182/121 |
| 3,511,338 | A | * | 5/1970 | Chapman | 182/121 X |
| 3,899,045 | A | * | 8/1975 | Geisel et al. | 182/121 |
| 4,085,819 | A | * | 4/1978 | Ohnstad | 182/121 |
| 4,211,307 | A | * | 7/1980 | Ethridge | 182/121 |
| 4,253,547 | A | * | 3/1981 | Skaalen et al. | 182/115 |
| 4,253,549 | A | * | 3/1981 | Petren | 182/150 |
| 4,306,700 | A | * | 12/1981 | Bell | 182/121 |
| 4,478,410 | A | * | 10/1984 | Ziegler, Jr. | 272/85 |
| 4,482,030 | A | * | 11/1984 | Lincourt | 182/121 |
| 4,533,018 | A | * | 8/1985 | Tyson | 182/121 |
| 4,618,030 | A | * | 10/1986 | Campbell | 182/121 |
| 4,911,265 | A | * | 3/1990 | Skaggs | 182/121 |
| 5,031,722 | A | * | 7/1991 | Renaud | 182/117 |
| 5,836,420 | A | * | 11/1998 | Marky, Jr. | 182/121 |
| 6,397,778 | B1 | * | 6/2002 | Tripp | 119/28.5 |

* cited by examiner

*Primary Examiner*—Bruce A. Lev
(74) *Attorney, Agent, or Firm*—Kenneth F. Pearce

(57) ABSTRACT

A personal stand incorporating a ladder, a user supporting platform and a load sensitive pliant suspender that is easily adapted for use with an extension ladder. The personal stand improves the user's footing as well as the user's comfort. Pliancy of the suspender allows the user to move the platform, without requiring the user to dismount the ladder. When sufficient load is applied to the platform, the pliant suspender is transiently transformed into a rigid suspender yoking an upper rung of the ladder.

20 Claims, 8 Drawing Sheets

Prior Art

PERSONAL STAND AND METHOD OF USING A PERSONAL STAND

This Application for Letters Patent relates back to non-provisional utility application, Ser. No. 09/571,220; filed May 16, 2000, now abandoned; Pass, Edward L.; entitled—Load Sensitive Attachment For Ladder—and is a continuation-in-part of the 09/571,220 Application that is incorporated herein by reference. In accordance with Title 35 of the United States Code, Applicant demands that all rights and benefits flowing from the Ser. No. 09/571,220 application be accorded to this co-pending application for Letter Patent.

BACKGROUND OF THE INVENTION

1. Field of the Invention

A personal stand, including a platform and a load sensitive pliant suspender, easily adapted for use with an extension ladder. The platform's collar and a suspender secure or moor the personal stand's portable platform to the ladder. In accordance with the present invention, it has been determined that the greater the load applied to the platform, the more rigidly and securely the attachment is affixed to the ladder. Importantly, the suspender remains pliant, until sufficient load is applied to cause the suspender to become rigid. Pliancy of the ungirded suspender allows the user of the attachment to move the attachment, with a single hand, while balancing on one of the ladder's rungs. Platforms can include traction enhancers and will have an upper surface area greater than the user's tracks. Methods of using the personal stand are also within the ambit of the present invention.

2. Description of the Previous Art a) U.S. Pat. No. 4,306,700—Bell enables a ladder jack. As best shown in the '700 Patent's FIG. 2 or this Application's FIG. 17, Bell's ladder jack mandates the use of two ladders (44) and their respective rungs (46). The combination of a first arm (14), a first hook (30), a first flexible member (16) of first ladder (44) and a second arm (14), a second hook (30) and a second flexible member (16) of second ladder (44) are required to support the workman's platform (50) between the two ladders (44). As shown in the '700 Patent, Bell's arm (14) cannot simultaneously furnish footing for both the workman's feet. Only when using two ladders, two arms, two hooks and two flexible members in combination with the extension of the workman's platform over each of arms communicating with their respective rungs can Bell generate synchronously footing for the workman's feet. Additionally and importantly, the workman's platform (50) is not attached directly to any rung of any ladder. Instead, the workman's platform (50) rests on the arms (14) communicating with each ladder (44). Further, Bell's flexible member (16) is connected to the arm (14) rather than the workman's platform (50). And as enabled, Bell's arm's hook (30) does not traverse as least one-half of the length of Bell's rung (46) to which the arm (14) is coupled.

b) U.S. Pat. No. 1,206,243—Peterson discloses a fruit picker's ladder. The '243 Patent teaches a rigid securing hook (32) for attaching the Peterson platform (30) to his upright. Peterson also mandates what appears to be upside-down Y members (36) and (38) that are attached to base members (11) and (12) instead of platform (30) that provides footing for the fruit picker. Based upon Peterson's disclosure, members (36) and (38) in combination with hook members (34) control the sway of Peterson's upright, i.e., fruit picker's ladder. Thus, Peterson's members (36) and (38) pull down rather than suspend, since members (36) and (38) are attached to ground level base members (11) and (12). Importantly, Peterson could have selected to utilize pliant suspenders, with his platform (30), at the time of his invention, but instead he utilized a rigid securing hook (32) to attach his platform (30) to his upright.

c) U.S. Pat. No. 1,920,552—Dollerhide discloses a plate that rests on the lower rung of the ladder. Dollerhide's plate utilizes two sturdy U-hooks to engage the rung above the plate. Specifically, U.S. Pat. No. 1,920,552 teaches the U-shaped rods are manufactured of metal. The Dollerhide device cannot be readily adjusted to the horizontal level position.

d) U.S. Pat. No. 2,104,987—Harding educates those skilled in the art to hinge a rigid hanger to the foot supporting platform. Harding's apparatus cannot be readily adjusted to the horizontal level position. The device further includes cleats to prevent horizontal movement of the platform. U.S. Pat. No. 2,104,987 also mandates the use of a flat spring and rivet combination for securing the hanger to the upper rung of the ladder.

e) U.S. Pat. No. 2,419,727—Picone enables a ladder platform with a rigid hook extending therefrom toward a rung superior to the platform. Additionally, U.S. Pat. No. 2,419,727 requires the single and rigid hook to be pivotally mounted to the platform. Picone's device cannot be readily adjusted to the horizontal level position. And further, according to Picone's disclosure, his hook incorporates his unique guard mechanism for preventing the hook from disengaging its rung, as weight is applied to his platform.

f) U.S. Pat. No. 3,552,523—Berkley shows a scaffold attachment for ladders. Berkley's attachment mandates a horizontal plate attached to the rung as well as a vertical plate mounted to his horizontal plate. Both of his plates are manufactured of unyielding aluminum. And for Berkley's invention to function, a hook which engages the ladder's rung must be pivotally attached to Berkley's vertical plate. Moreover, Berkley's device cannot be readily adjusted to the horizontal level position.

g) U.S. Pat. 5,836,420—Markey, Jr. teaches those skilled in the art to make a one piece sturdy frame that, among other things, has a pair of upwardly extending arms which include a pair of prefabricated curvatures at their apex for hooking onto the rung. U.S. Pat. No. 5,836,420 mandates a substantially square platform be attached to the lower area of Markey's frame. Simultaneously there must be at least one ladder's rung between the lower area and the upper area of Markey's frame. And finally, Wood, hard plastic or metal is used to manufacture Markey's platform.

h) U.S. Pat. No. 4,911,265—Skaggs shows a ladder platform with a rung securing mechanism. Skaggs'disclosure commands that a pair of brackets are bolted to the foot platform. Those brackets further include arcuate elements for hooking the rung. And U.S. Pat. No. 4,911,265 also teaches that set screws and clamps secure the arcuate members to the rung.

i) U.S. Pat. No. 3,511,338—Chapman enables a ladder stand. Chapman's disclosure exudes rigidity. His steel foot plates are attached to steel rods having steel hooks which can be attached to the ladder's rung.

j) U.S. Pat. No. 151,429—Pritchard is directed to an improvement in firemen's ladders. Pritchard teaches that platforms should be permanently hinged to the rungs of the ladder. Additionally and importantly, U.S. Pat. No. 151,429 also mandates that at least two chains are simultaneously as well as terminally mounted to both the ladder and the platform.

k) U.S. Pat. No. 1,450,312—Stolworthy discloses an extension ladder. The Stolworthy ladder mandates utilization of the combination of a pair of platforms. Moreover, each platform is supported by a pair of rigid braces which also include hooks for engaging the ladder's lower rung. The teachings of U.S. Pat. No. 1,450,312 dictate that Stolworthy's platforms must also include a pair of chains. Additionally, each chain must have its hook securely fastened to the ladder's upper rung to steady Stolworthy's braced platform.

l) U.S. Pat. No. 5,388,665—Newman enables an adjustable ladder platform. Newman's platform is rigidly secured to the ladder by his side members. The apparent unique feature of the U.S. Pat. No. 5,388,665 is his ratcheting mechanism to facilitate the angling of his platform.

m) U.S. Pat. No. 5,465,809—Panicci discloses a safety platform unit for ladders. Panicci requires mirror image torque arms to support his platform member. Each of the U.S. Pat. No. 5,465,809 torque arms include a unique locking mechanism which engages the ladder's rung to secure the Panicci platform to the ladder.

n) U.S. Pat. No. 5,072,808—Spait, et. al., dictates a slidable ladder adaptable platform that is permanently attached to the ladder. To practice Spait, et. al., the user slides the platform up-and-down the ladder's rungs.

o) U.S. Pat. No. 362,747—Higgins enables a bracket for suspending a platform.

p) U.S. Pat. No. 2,148,958—Myers teaches a hanging rigid step attachment for a ladder.

q) U.S. Pat. No. 356,457—Dudley teaches a combined ladder-holder and scaffold-bracket. As enabled, Dudley's scaffolding requires the use of two ladders, with a bracket attached to each ladder for supporting the workman's platform above ground level.

r) U.S. Pat. No. 2,237,596—Eilers discloses a device for coupling his ladder to its uppermost supporting surface.

s) U.S. Pat. No. 2,578,862—Tims enables a ladder jack.

t) U.S. Pat. No. 2,592,006—Burke teaches a prop attachment for ladders.

u) U.S. Pat. No. 3,98,416—Benolkin shows a paint can support that is attached to the ladder.

v) U.S. Pat. No. 4,442,920—Gronbeck, et. al., teaches a collapsible ladder held by a pair of ropes.

w) U.S. Pat. No. 4,482,030—Lincourt enables a rigid foot platform attached to upper and lower rungs of the Lincourt ladder.

x) U.S. Pat. No. 4,862,994—Hughes shows a foldable platform for attachment to the ladder.

y) U.S. Pat. No. 4,972,923—Krause enables a stepping platform for a ladder that includes a rigid suspending member.

z) U.S. Pat. No. 4,987,972—Helms reveals a tree climbing apparatus.

aa) U.S. Pat. No. 5,094,319—Kobasic teaches a ladder stand.

ab) U.S. Pat. No. 5,161,640—Holbrooks, et. al., shows a mechanic's workstation for use in reaching engine compartments of motor vehicles.

ac) U.S. Pat. No. 5,460,241—LaBelle enables a ladder accessory for assuring that the ladder leans against the wall at an angle of 75° from horizontal.

ad) U.S. Pat. No. 5,950,972—Irish discloses a container for holding items mounted to the top step of a stepladder.

ae) U.S. Pat. No. 6,109,392—Merrick shows a split platform ladder stand.

af) U.S. Pat. No. 6,189,652B1—Brown, et. al., enables a generally upside-down L user supporting platform, wherein the Brown platform is supported by an upper and lower rung of the their ladder.

SUMMARY OF THE INVENTION

The present invention relates to personal stands that utilize a single ladder, a single platform conformed to communicate with one of the ladder's rungs corresponding to the personal stand's collar and a load sensitive pliant suspender extended above the platform and girded about a higher rung of the ladder. Any method acceptable within the art for securely attaching the pliant suspender to the platform, such as, clips, eyelets, nuts and bolts, etcetera, can be utilized. Within the ambit of the present invention, a clasp secures the load sensitive pliant suspender about one of the ladders rungs to itself. This wrapping of the suspender around the rung creates a yoke or girdle about the rung. The attachment's clasp can range from the more complex block and tackle devices to such other diverse structures as simple as ties, knots, clips, vises, clamps or S-hooks.

Both the pliant suspender and the platform are sensitive to the application of load to the platform. When adequate load is applied to the platform, the pliant suspender is transiently transformed into a rigid suspender such that the combination of the rigid suspender and platform provide a stable and secure personal stand for the user. After such load is removed from the platform, the suspender returns to pliancy.

For enhanced safety, the portable platform can be provided with an abrasive or raised section to enhance the user's traction. The traction enhancer can be applied to the user supporting platform in any manner suitable in the art from milling to sanding to molding or adhesion. In accordance with the present invention, the platform is made of any material capable of carrying loads of up to about 180 kilograms. Examples of such materials include plastics, metals and wood products. Further still, within the scope of the present invention, the portable platform should be lightweight enough to allow its user to move it from one rung to another while balancing himself on the ladder, with his other hand. In fact, one novel feature of the present invention is that the user can move the platform higher or lower relative to height of the ladder, without requiring the user to dismount the ladder.

As indicated previously, the present invention also includes a depending collar for further securing the portable platform to one of the ladder's rungs. The collar can be manufactured of any suitable material capable of sturdily engaging the rung, or the collar may be created by openings in the skirt that depends downward from the user supporting platform. Additionally, the collar may be provided with a safety catch.

In accordance with the current personal stand, as load is applied to the portable platform, the clasp yokes the load pliant suspender about the rung. Further, the combination of the suspender and clasp allow the user to adjust the platform to create a substantially horizontal footing for the user. And when adequate load is applied, the load sensitive pliant suspender is transiently transformed into a rigid suspender. It has unexpectedly been determined that loads in the range of about 9 kilograms to about 180 kilograms or more can transform the load sensitive pliant suspender into the rigid suspender. The combination of the rigid suspender and the portable platform provide a steady and sturdy personal stand for the user that is moored to the ladder. Yet, at the same time, for example, when the operator shifts his weight off the platform, he can easily move the attachment with a single hand without having to dismount the ladder. Additionally, it has unexpectedly been discovered that utilization of a two membered load sensitive pliant suspender instead of a single membered load sensitive pliant suspender dampens the potential for side-to-side torque. Further, it has been discovered that the load sensitive pliant suspender formed in the shape of an upside-down Y renders the greatest stability in accordance with the present invention. Yet further still and within the scope of the present invention, load sensitive pliant suspenders include such materials as, ropes, cables, chains, plastics, rubbers and leathers. In other words, most any material having adequate strength to support 180 kilograms or more that is also pliant in its unused state could function as a suspender, in accordance with the present invention. Additionally, platforms made of aluminum and having a thickness of about 4 millimeters to about 6 millimeters have improved the overall stability of the personal platform by decreasing the vacillating wobble associated with less firm materials.

An object of the present invention is to provide a lightweight personal platform that improves the user's footing, as compared to standing only on a rung of the ladder.

It is another object of the present invention to provide a personal stand that the user can move from rung to rung for predetermined distances.

Still another object of the present invention is to provide a platform that decreases stress on the user's feet commonly associated with standing on rungs for prolonged periods.

Yet another object of the present invention is to provide a personal stand having a platform that can be adjusted up or down relative to the ladder's rungs, without requiring the user to dismount the ladder to adjust the attachment.

It is yet another object of the present invention to provide a personal stand that utilizes a load sensitive pliant suspender that is transiently transformed into a rigid suspender as load is added to the platform such that the platform is moored to the ladder.

Still another object of the present invention is to provide a personal stand that can safely support from about 9 kilograms to about 180 kilograms.

Yet another object of the present invention is to provide a personal stand incorporating a load sensitive pliant suspender of adequate length to allow the platform to be adjusted to substantially horizontal.

Yet still another object of the present invention is to integrate a traction enhancer with an upper surface of the platform.

Yet another object of the present invention is to allow the user easy and safe ingress to the platform.

It is yet still another object of the present invention to allow the user easy and safe egress from the platform.

Yet still another object of the present invention is to provide an anchor for securing the personal stand's platform to the ladder.

Still another object of the present invention is to provide a personal platform with a decreased vacillating wobble.

An embodiment of the present invention can be described as a personal stand for supporting the user, comprising: a ladder; a user supporting platform creating a footing for the user's feet, the platform further comprising: a first end communicating with a first rung of the ladder such that the first end's width traverses at least one-half said length of the first rung but less than an entire length of the first rung, an upper surface area greater than a pair of tracks, a section for enhancing the user's traction of greater area than the area of the pair of tracks, and a depending collar at the first end for engaging the first rung; a load sensitive pliant suspender attached to a second side of the user supporting platform, wherein the load sensitive pliant suspender is extended upward from the user supporting platform and girded about a second and higher rung such that as load is applied to the user supporting platform the load sensitive pliant suspender is transiently transformed into a rigid suspender; and a clasp.

A method of using the present invention can comprise the steps of: leaning a ladder against a substantially vertical stop; mounting the ladder; moving the personal platform up the ladder for a predetermined distance; balancing on a rung of the ladder, until the personal stand is moored to the ladder; creating a footing, incorporating the platform, for supporting the user's feet; attaching a load sensitive pliant suspender to the platform; extending the load sensitive pliant suspender toward a higher rung; girding the rung with the load sensitive pliant suspender; clasping the load sensitive pliant suspender to yoke the rung; adjusting the load sensitive pliant suspender to where the footing is substantially horizontal; and standing on the platform.

Another embodiment of the present invention can be described as a personal stand for supporting the user, comprising: a ladder; a user supporting platform creating a footing for the user's feet, the platform further comprising: a first end communicating with a first rung of the ladder such that the first end's width traverses at least one-half said length of the first rung but less than an entire length of the first rung, an upper surface area greater than a pair of tracks, a section for enhancing the user's traction of greater area than the area of the pair of tracks, and a depending skirt having a pair of openings therein forming a collar at the first end for engaging the first rung; a load sensitive pliant suspender attached to a second side of the user supporting platform, wherein the load sensitive pliant suspender is extended upward from the user supporting platform and girded about a second and higher rung such that as load is applied to the user supporting platform the load sensitive pliant suspender is transiently transformed into a rigid suspender; and a clasp.

It is the novel and unique interaction of these simple elements which creates the personal stands and methods of using personal stands, within the ambit of the present invention. Pursuant to Title 35 of the United States Code, descriptions of preferred embodiments follow. However, it is to be understood that the best mode descriptions do not limit the scope of the present invention. The breadth of the present invention is identified in the claims appended hereto.

DESCRIPTION OF THE PREFERRED EMBODIMENTS

Although the disclosure hereof is detailed to enable those skilled in the art to practice the invention, the embodiments published herein merely exemplify the present invention which can be practiced in other specific structures.

Figures 1, 2, 3:
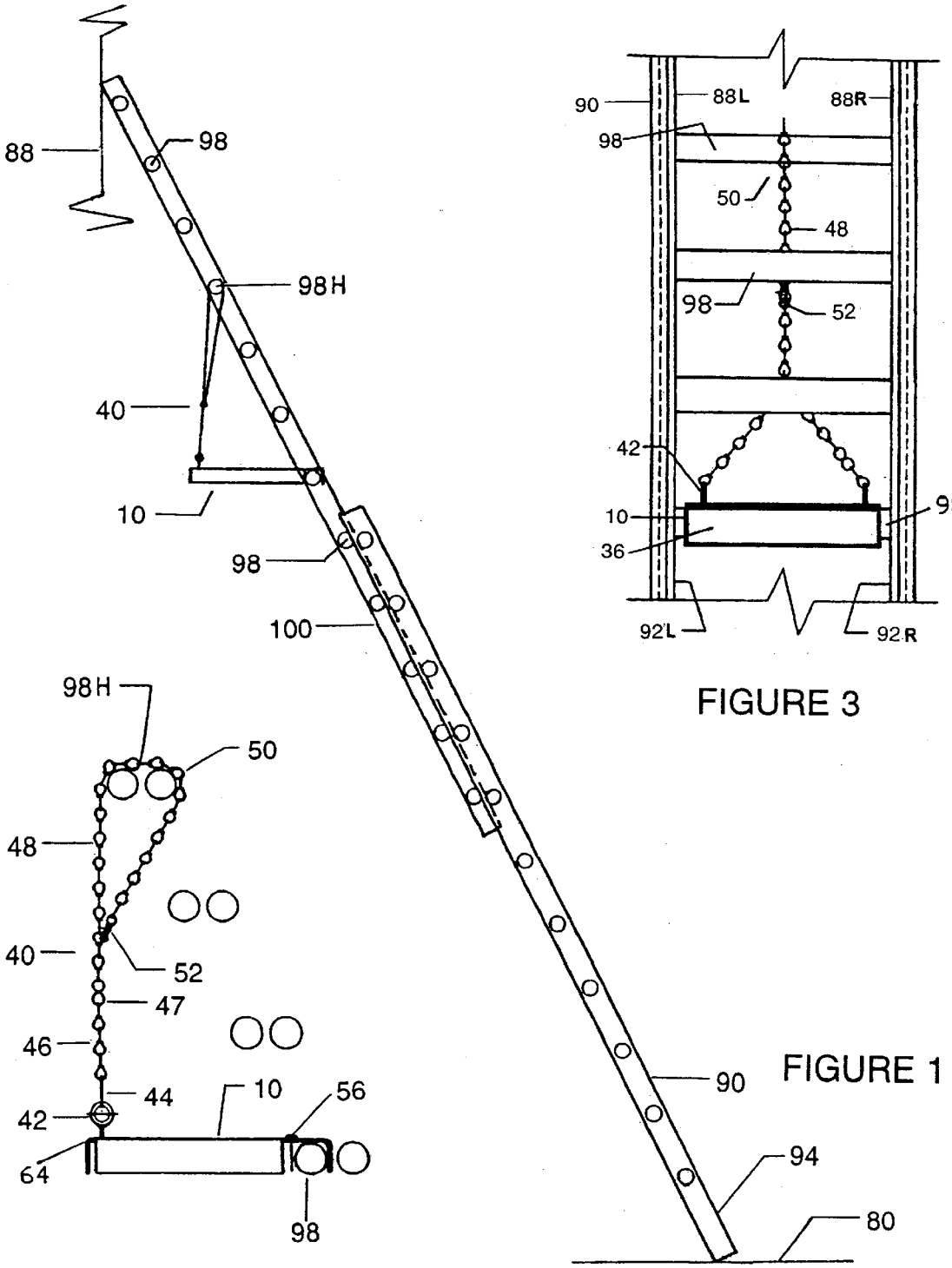
FIG. 1 is a lateral depiction of a personal stand of the present invention.
FIG. 2 is a side view of the platform not showing the posts of the ladder but having the pliant suspender and the platform attached to the rungs of the ladder such that the pliant suspender is transiently transformed into the rigid suspender of the present invention, as the pliant suspender girds and yokes a higher rung of the ladder.
FIG. 3 is a frontal pictorial of the personal stand having a platform that traverses virtually the entire length of the rung of the ladder.

Looking at FIG. 1, an abstraction of the present invention is depicted. Ladder (100) has a plurality of rungs (98), a pair of upper portions (96) for resting against the substantially vertical stop (82), such as, the wall or roof of a building, and a pair of feet (94) for engaging base (80), such as, the ground or concrete, etc. As shown, ladder (100) is what is commonly referred to as an extension-ladder, but other types of ladders can be utilized to practice the current personal stand. Ladder (100) has a pair of posts (90) communicating with an extension and corresponding pair of posts (88) which can be extended above posts (90) to rest against vertical stop (82). And although not shown in FIG. 1, FIG. 3 reveals ladder (100) has post (90R) and post (90L) and a plurality of rungs (98) interposed between post (90R) and post (90L). In a similar vein, posts (88 R) and (88 L) also include a plurality of rungs (98) interposed there between, which can also be utilized for mooring platform (10) to ladder (100). In short, the current personal stand (8) can be practiced with different kinds of leaning ladders, including ladders commonly known as extension ladders.

Figure 6:
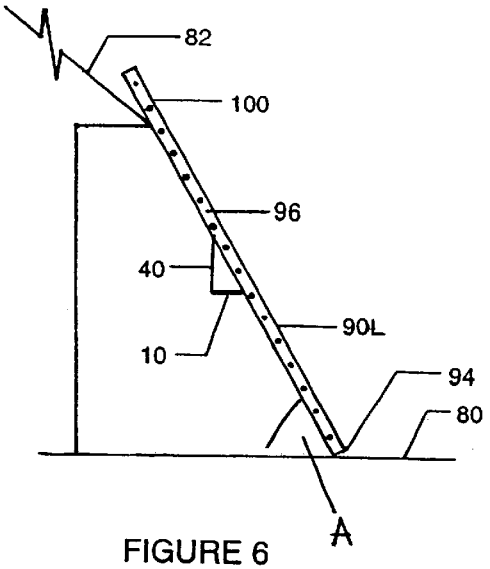
FIG. 6 is a lateral pictorial of the personal stand leaning against a building's roof.

With a view toward FIG. 6, ladder (100) has an upper portion (96) for resting against substantially vertical stop (82) and feet (94) for engaging base (80). In the practice of the present invention, ladder (100) is seated, such that, angle A, defined by the common span of post (90L) (shown) and (90R) (not shown), referenced against base (80) and substantially vertical stop (82), is sloped to less than perpendicular, as measured along the common span, from its upper portion (96) to its feet (94).

Returning to FIG. 3, posts (88 R) and (88 L) have inner surfaces (92 R) and (92 L). The interposed distance between inner surfaces (92 R) and (92 L) represents the maximum usable length for any of the plurality of rungs (98). Additionally, the combination of posts (90 R), (90 L) and their corresponding plurality of rungs (98) further define the common span of ladder (100). And with respect to the descriptions of the preferred embodiments of personal stand (8), rung (98 H) represents a higher rung (98) while rung (98 L) represents a lower rung (98).

With reference to FIGS. 1–13, platform (10) is seen. Platform (10) can be composed of wood, metal or plastic, and it has been determined that platforms manufactured of aluminum having a thickness of from about 4 millimeters to about 6 millimeters diminish the vacillating wobble attributed to platforms made of less sturdy compositions. Whatever the composition selected for platform (10) of personal stand (8), platforms (10), within the scope of the present invention, can carry loads of from about 9 kilograms to about 180 kilograms.

Figure 8:
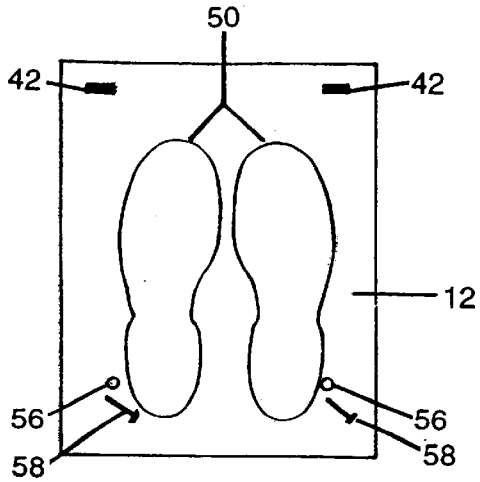
FIG. 8 is a planar view of the upper surface area of platform including a representative pair of user's tracks.
Figure 7:
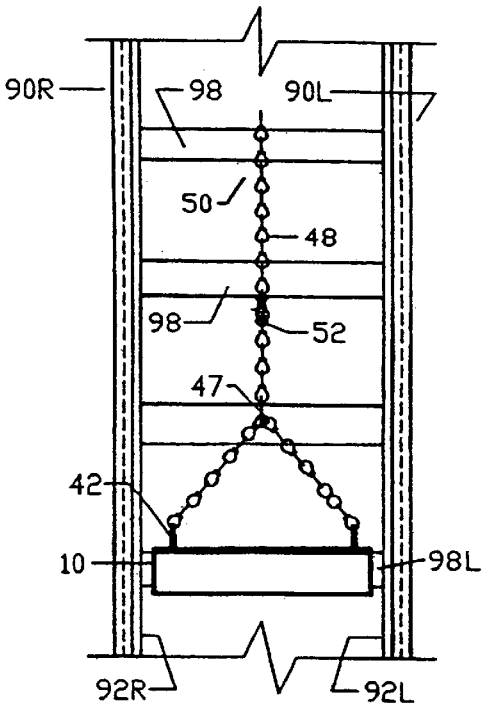
FIG. 7 is a frontal pictorial of the personal stand having a platform that traverses approximately one-half the length of the rung of the ladder.
Figure 9:
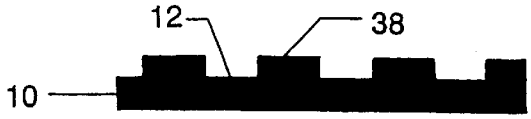
FIG. 9 is a cross-section of a metal platform that has raised sections of traction enhancers.
Figure 10:
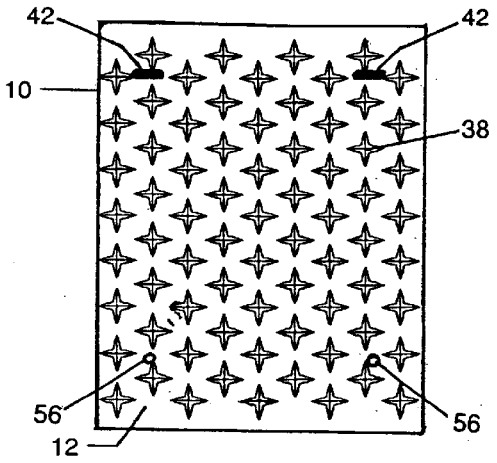
FIG. 10 is a planar view of the upper surface area of the platform having a raised section of traction enhancers.

As best represented in FIG. 3, platform (10) traverses almost the entire length of rung (98 L) while for the embodiment depicted in FIG. 7, platform (10) traverses approximately one-half the interposed length of rung (98 L). It has been unexpectedly discovered that personal stands of the present invention function as intended to support the user, as long as end (36) of user supporting platform (10) communicates with rung (98) and traverses at least one-half the length of rung (98). As best shown in FIG. 8, such dimensioning of platform (10) of stand (8), functions to create an upper surface area (12) of platform (10) that is of greater surface area than the contact surface area of the user's tracks (50). With respect to this Application for Letters Patent, the user's tracks represent the area of the user's shoes, boots or bare feet resting upon the upper surface area (12) of platform (10), when the user has both feet (covered or uncovered) contacting upper surface area (12).

Figure 4:
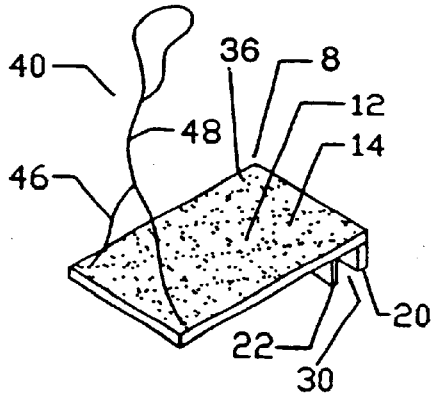
FIG. 4 is a planar pictorial view of the present invention.

It is believed that practicing the present invention distributes the user's weight more evenly about the contact area of the feet and results in less stress applied to the user's feet than when standing on a rung alone. In furtherance of the practice of select embodiments the current invention and as shown in FIG. 4, platform (10) can have abrasive section (14) adhered to upper surface (12) for enhancing traction of the user. And FIGS. 9 and 10 portray a user supporting platform (10) composed of metal having upper surface (12) that includes traction enhancer sections (38) raised above platform (10). Regardless of whether abrasive section (14), raised sections (38), or another type of traction enhancing section is utilized, the surface area of the traction enhancer is greater than the user's tracks. For certain embodiments of the current personal stand (8), platform (10) can have a length of about 480 millimeters, a width of about 300 millimeters and a thickness of about 45 millimeters.

As best shown in FIGS. 2 and 4, platform (10) has a pair of depending rails (20) and (22). In one embodiment, rail (20) has a height of about 30 millimeters, a length of about 300 millimeters and a width of about 25 millimeters while rail (22) has a height of about 30 millimeters, a length of about 300 millimeters and a width of about 16 millimeters. Although not shown, rail (20) is bolted to platform (10) while rail (22) is nailed to platform (10). In this specific embodiment, depending rails (20) and (22) are spaced about 45 millimeters apart, and rails (20) and (22) create collar (30). Additionally, collar (30) can also be equipped with safety catch (32). In this specific embodiment, safety catch (32) pivots to enclose lower rung (98 L) inside the combination of safety catch (32) and collar (30).

In accordance with the present invention, depending collar (30) is proximate first end (36) of platform (10) and engages lower rung (98L) of ladder (100) by gripping upper surface (97) of lower rung (98 L). Moreover, it has unexpectedly been discovered depending collar (30) of this particular embodiment will proficiently grip upper surface (97) of lower rung (98 L) of ladder (100) as long as depending collar (30) has at least a three (3°) degree arc curving about the upper surface (97). And although not specifically represented, those skilled in the art will comprehend that collar (30) can be of adequate dimension to engage a pair of lower rungs (98 L), e.g., corresponding rungs (98L) of posts (90) and posts (88).

As previously set forth, platform (10) can be made of metal, plastic, wood or wood product, and depending upon the composition of platform (10), collar (30) can be molded or shaped as part of platform (10), as well as adhered or connected to platform (10), in any manner acceptable in the art. Further, as rendered in FIGS. 11 and 12, collar (30) can also be created by a pair of openings (62) of skirt (60) of platform (10) of stand (8). Skirt (60) depends downward from an outer circumference (64) of user supporting platform (10). It has unexpectedly been determined that skirt (60) reduces the vacillating wobble, due to the user's shifting weight, that may be associated with practice of some embodiments of the present invention.

Figure 12:
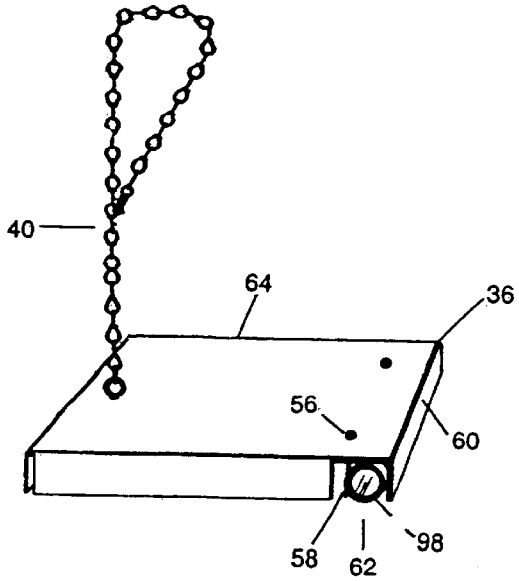
FIG. 12 is lateral pictorial of the platform including the skirt and the openings creating the personal scaffold's collar.

With a view toward FIGS. 8, 10, 11 and 12, apertures (56) are proximate first end (36) of platform (10). Some embodiments of the current personal stand also include pins (58) for insertion through apertures (56). As best shown in FIG. 12, pin (58) is inserted through aperture (56) to secure user supporting platform (10) against rung (98 L). This particular feature allows opening (62) of user supporting platform (10) to be dimensioned for communication with a multitude of rung diameters.

Figure 13:
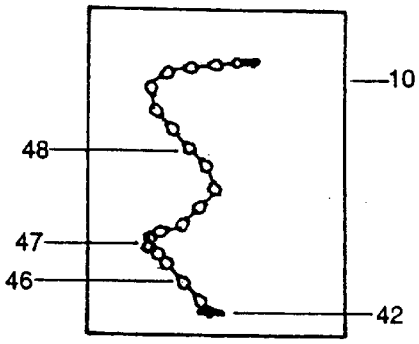
FIG. 13 is a planar view of the upper surface area of the platform having an unextended two member load sensitive pliant suspender deposited thereon.

FIGS. 1, 2, 3, 5, 6, 7, 11 and 12 show platform (10) with suspender (40) extending upwardly while FIGS. 4 and 13 depict a very pliant suspender (40). As previously indicated above, until sufficient load is applied to platform (10), suspender (40) is pliant and easily adjusted by the user of the present invention, without requiring the user to dismount ladder (100). Pliant suspender (40) may be a chain or a cable, or it can be made of plastic, leather or rubber.

FIG. 12 shows a single member pliant suspender (40). A two member (46, 48) pliant suspender (40) attached to user supporting platform (10) at a single location is set forth in FIG. 13. Members (46 and 48) are coupled together with S-hook (47). And in a similar but different vein, FIGS. 3, 4, 7 and 11 enable a two member (46, 48) pliant suspender (40) coupled to user supporting platform (10) at two locations. Very importantly, whether a single or a two member pliant suspender is incorporated the practice of the current personal stand, pliant suspender (40) is of adequate length so the user can adjust platform (10) to where platform (10) creates a footing for the user and is substantially parallel to base (80) engaging feet (94) of ladder (100). Further, regardless of the embodiment of personal stand practiced, pliant suspender (40) is attached to a second side or end opposite first end (36) of platform (10).

Figure 5:
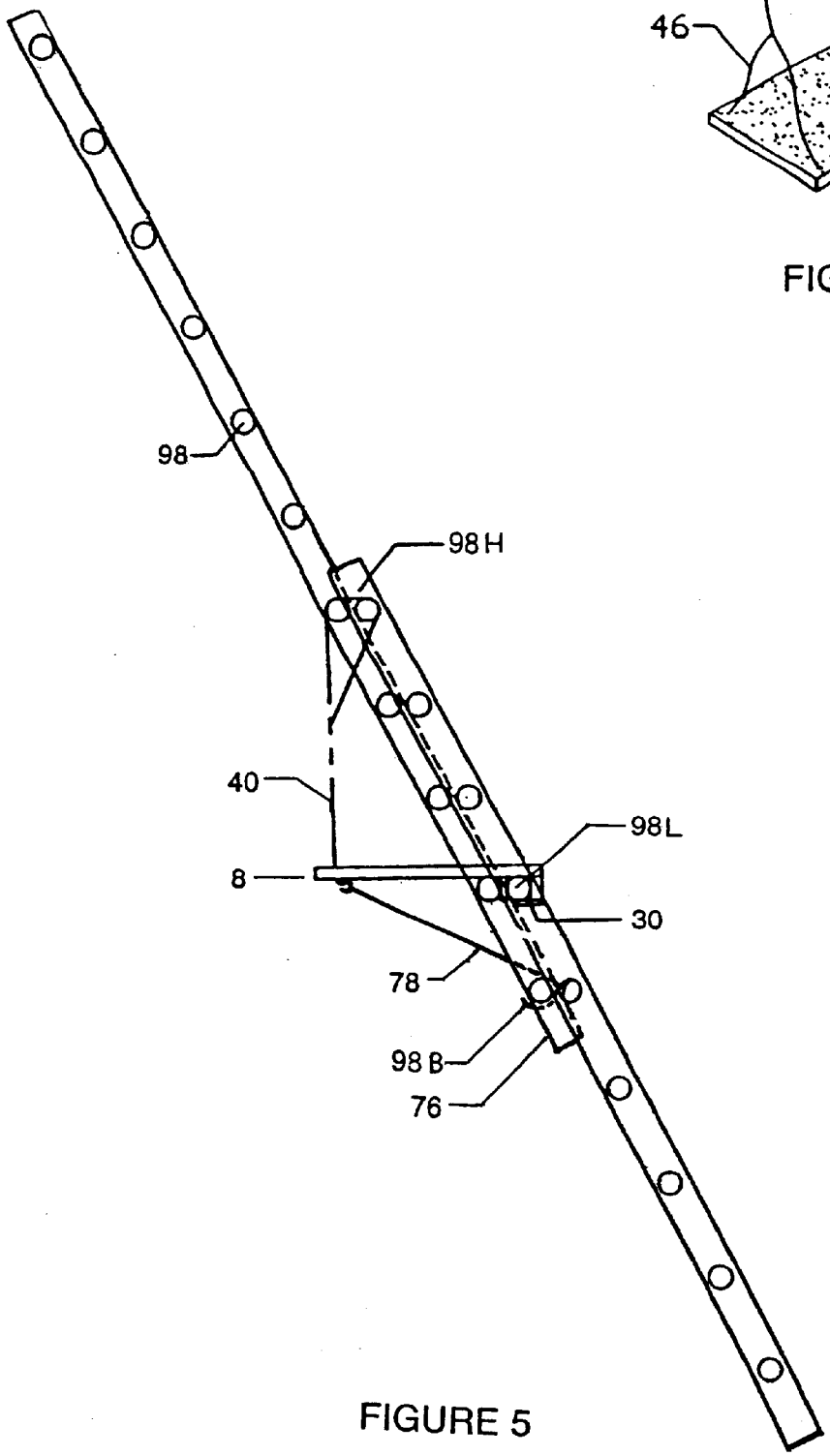
FIG. 5 is another lateral pictorial of the present invention.
Figure 11:
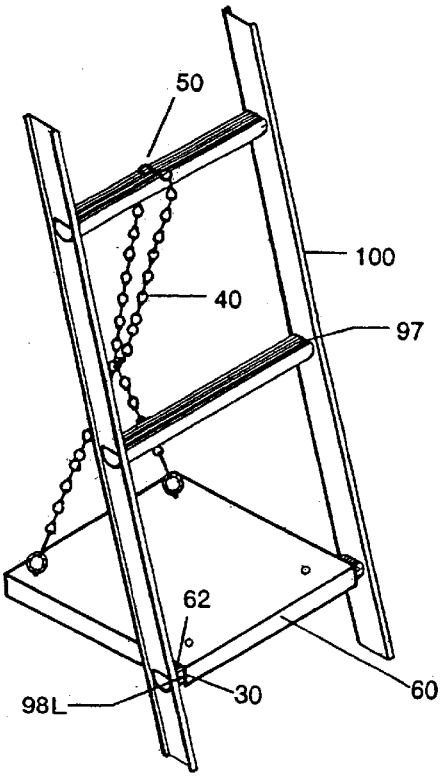
FIG. 11 is a lateral pictorial of the personal stand having a platform that includes a downward depending skirt and an upside-down Y configured load sensitive pliant suspender.

Those skilled in the art recognize a plethora of devices can be utilized to connect pliant suspender (40) to user supporting platform, but turning expressly toward FIG. 2, suspender (40) is connected to platform (10) via eyelet bolt (42) and S-hook (44). Extending upwardly from eyelet bolt (42) and S-hook (44), suspender (40) girds rungs (98H) and creates a girdle or yoke (50). FIGS. 2 and 5 reveal that yoke (50) girds two rungs (98H) of ladder (100) while FIGS. 1 and 11 show yoke (50) can also easily function in girding a single rung (98H) of ladder (100).

Returning now to the embodiment set forth in FIG. 2, after suspender (40) is wrapped around rungs (98H), suspender (40) is further connected to suspender (40) via clasp (52). As shown, clasp (52) is a self-biasing clip. However, other clasps, such as, hooks, ties, knots, vises and S-hooks also function, in accordance with the current personal stand. Importantly, those skilled in the art will recognize it is the unique interaction between the yoke (50) and load applied to platform (10) that transiently transforms suspender (40) from its pliant to its rigid state. Suspender (40) and clasp (52) also allow the user to adjust personal stand (8) to where platform (10) is substantially horizontal. When load is removed, suspender (40) returns to its pliant state allowing the user to move the present invention, without requiring the user to dismount from ladder (100).

In accord with the embodiment portrayed in FIGS. 3 and 4 and as previously set forth above, suspender (40) includes first and lower member (46) and second and higher member (48). S-hook (47) couples first member and lower member (46) to second and higher member (48). In this particular exemplification, first and lower member has a length of about 660 millimeters and second and higher member (48) has a length of about 530 millimeters such that, when looking at suspender (40) from the attachment's frontal view, suspender (40) appears as an upside-down Y. It has unexpectedly been determined that utilization of suspender (40) in the upside-down Y configuration improves stability of user supporting platform (10). FIGS. 7 and 11 utilizing the skirted platform (10) also teach a suspender (40) fashioned as an upside-down Y.

As best demonstrated in FIG. 5, personal stand (8) can be equipped with anchor (72). Although not shown, anchor (72) is clipped to bottom of user supporting platform (10) and has hook (76) engaging rung (98 B), inferior to rung (98L). In this preferred embodiment, anchor (72) has an elastomeric body (78), but those skilled in the art understand that anchor (72) need not be elastomeric, nor include hooks and clips.

Figure 14:
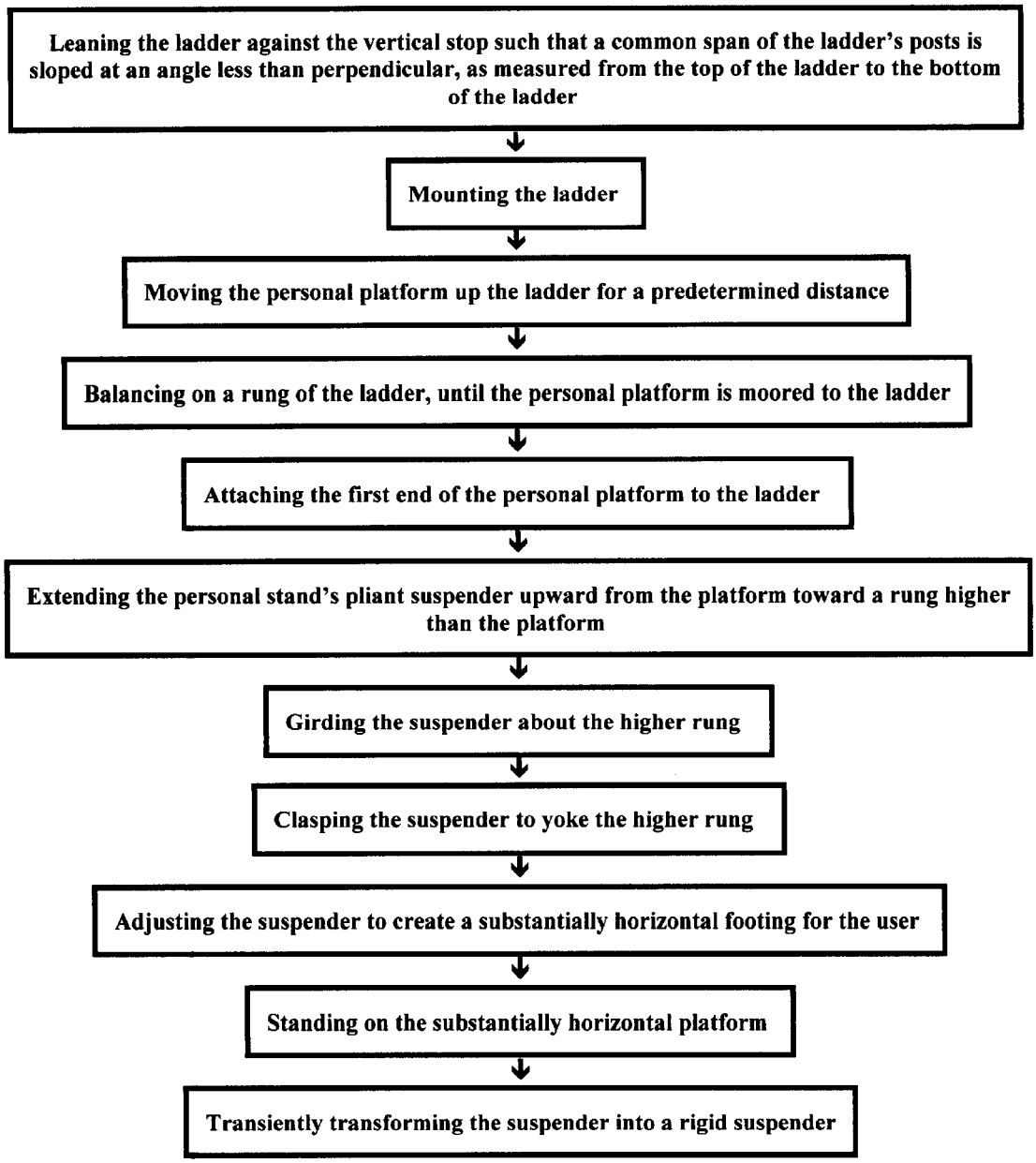
FIG. 14 is a depiction of the steps of another embodiment of the present invention.
Figure 15:
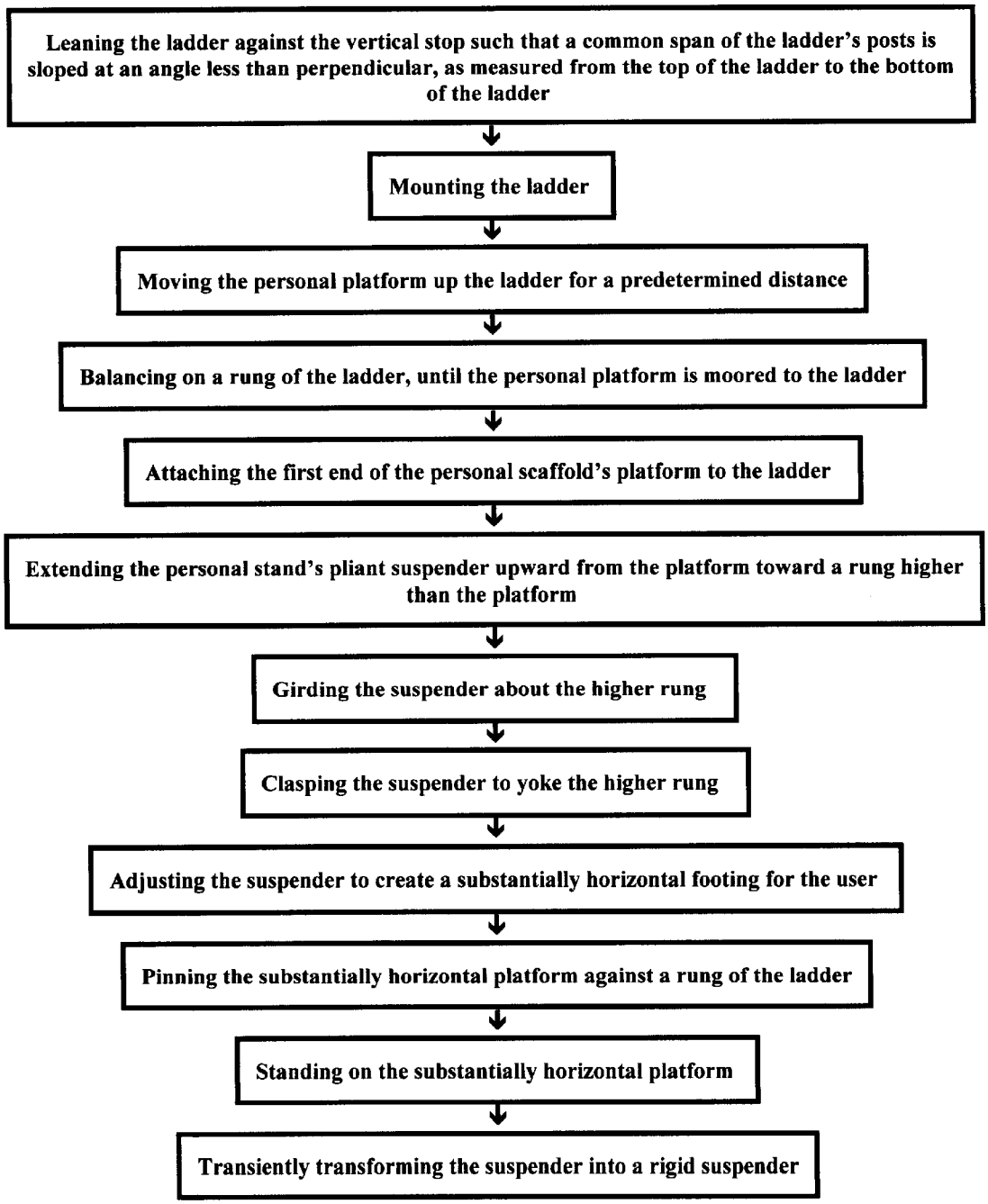
FIG. 15 is an exemplification of the steps of yet another embodiment of the current method.
Figure 16:
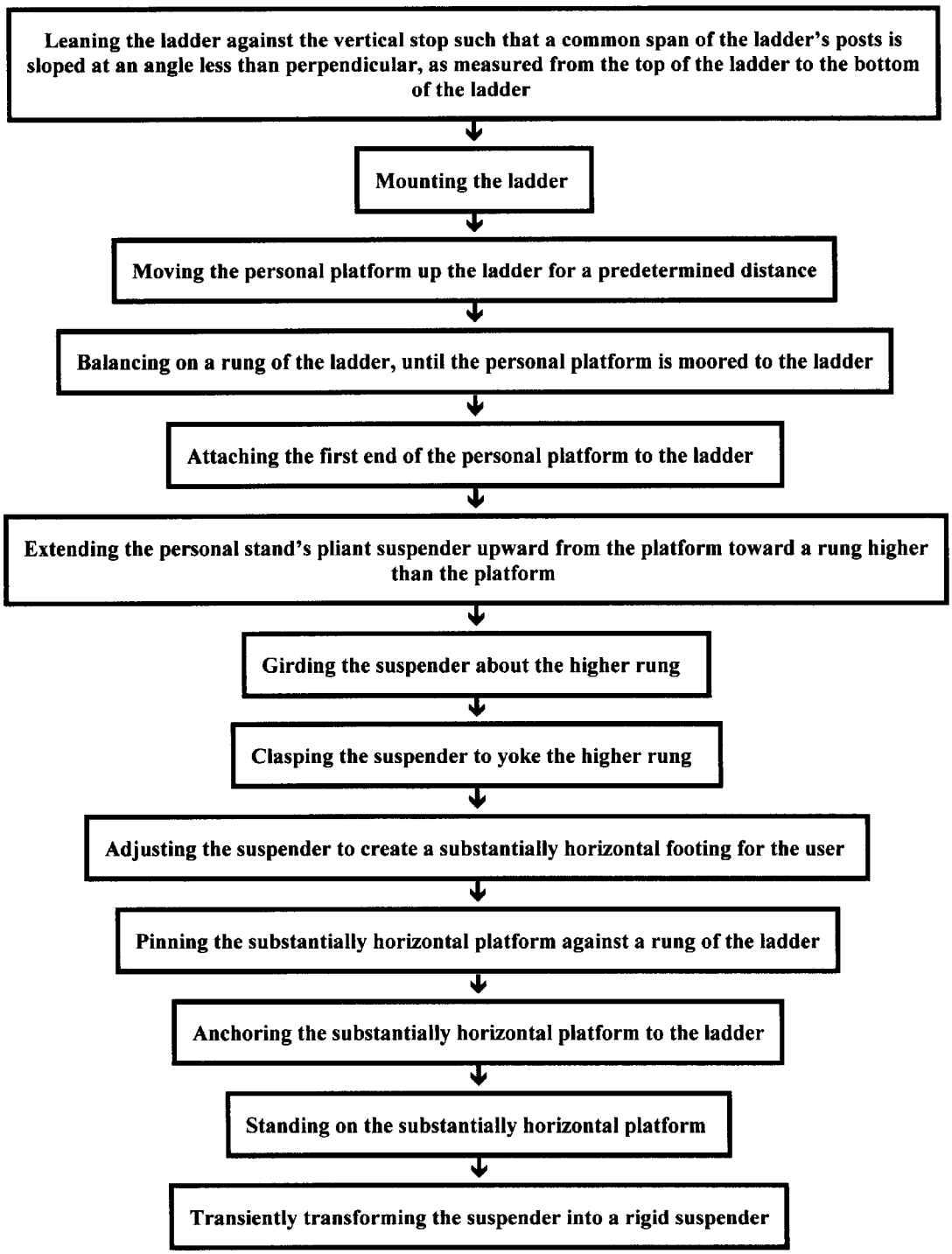
FIG. 16 is a diagrammatic representation of the steps of still another embodiment of the present invention.
Figure 17:
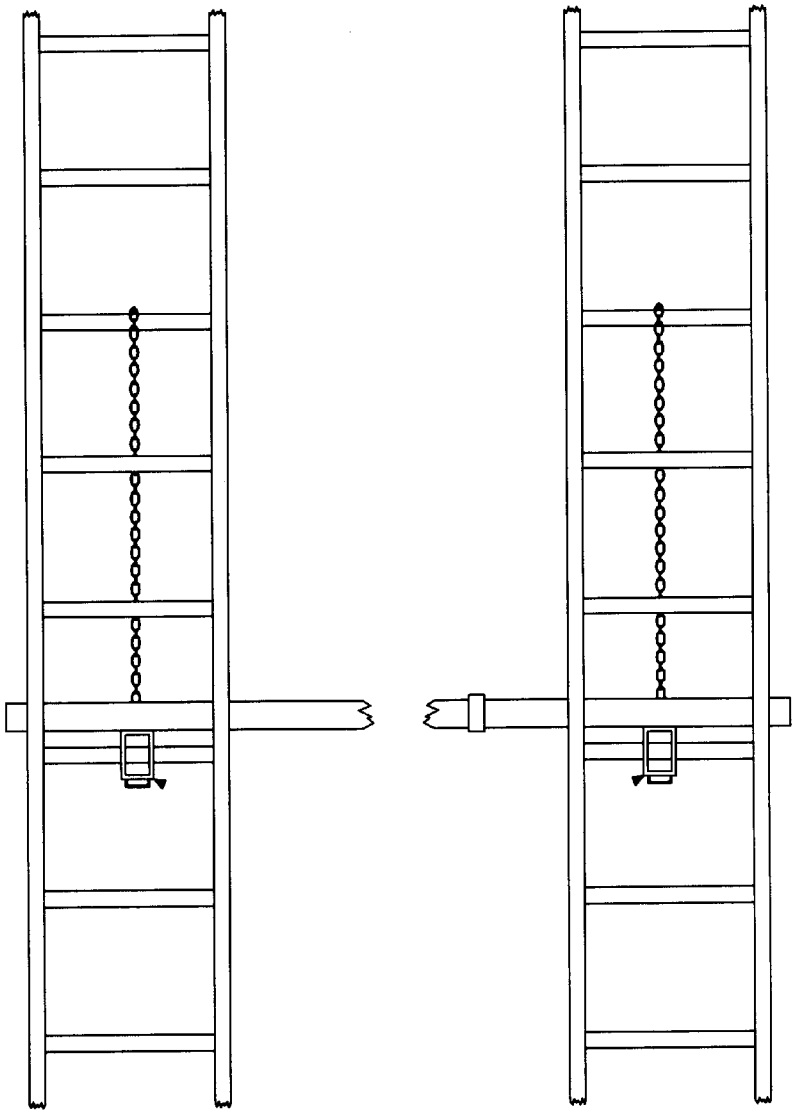
FIG. 17 is the prior art invention disclosed in U.S. Pat. No. 4,306,700—Bell.

Steps associated with the practice of the methods of the current personal stand utilizing select structural elements enabled above are set forth in FIGS. 14–16. Steps for creating a footing for the user include: leaning the ladder; mounting the ladder; carrying the personal stand up the ladder a predetermined distance; balancing on the ladder, until the footing is created; and extending the load sensitive pliant suspender to yoke a rung superior to the user supporting platforn. Additional steps which can be incorporated into the practice of the current personal stand are: adjusting the suspender to where the platform is substantially horizontal; pinning the stand against the rung of the ladder; and anchoring the platform to the ladder.

Having disclosed the invention as required by Title 35 of the United States Code, Applicant now prays respectfully that Letters Patent be granted for his invention in accordance with the scope of the claims appended hereto.

What is claimed is:

1. A personal stand for supporting a user, comprising:

a) a ladder, including:

i) a first post, wherein said first post further comprises:

A) a first foot for engaging a base; and

B) a first upper portion for resting against a substantially vertical stop;

ii) a second post parallel to said first post, wherein said second post further comprises:

A) a second foot for engaging said base; and

B) a second upper portion for resting against said substantially vertical stop;

such that a common span of said first post and said second post is sloped at an angle less than perpendicular; and iii) a plurality of rungs attached to and fixed between said first post and said second post, wherein a length for each of said plurality of rungs is determined by an interposed distance between said first post and said second post;

b) a user supporting platform creating a footing for said user's feet, further comprising:

i) a first end communicating with a first rung of said ladder such that said first end's width traverses at least one-half said length of said first rung but less than an entire length of said first rung;

ii) an upper surface area greater than a bottom surface area of said user's feet, when said user is standing on said user supporting platform;

iii) a section adapted for enhancing said user's traction, wherein said section is of greater surface area than said bottom surface area of said user's feet, when said user is standing on said user supporting platform; and iv) a depending collar at said first end for engaging said first rung;

c) a load sensitive pliant suspender attached to a second end of said user supporting platform opposite said first end of said user supporting platform:

i) wherein said load sensitive pliant suspender is extended upward from said user supporting platform and toward a second and higher rung relative to said first rung; and ii) wherein said load sensitive pliant suspender is girded about said second and higher rung such that as load is applied to said user supporting platform said load sensitive pliant suspender is transiently transformed into a rigid suspender, until said load is displaced from said user supporting platform; and d) a clasp for securely yoking said load sensitive pliant suspender about said second and higher rung, wherein said clasp is connected to said load sensitive pliant suspender at a location between said upper surface area of said user supporting platform and said second and higher rung to selectively adjust said load sensitive pliant suspender such that said user supporting platform is substantially parallel to said base engaging said first post and said second post of said ladder.

2. The invention of claim 1 wherein said load sensitive pliant suspender comprises:

i) a first member attached to said user supporting platform; and ii) a second member fastened to said first member and coupled to said clasp.

3. The invention of claim 2, said personal stand further comprising:

i) an aperture proximate said first end of said user supporting platform; and ii) a pin for securing said user supporting platform against said first rung.

4. The invention of claim 3 further comprising:

a) a first corresponding post communicating with and extending above said first post;

b) a second corresponding post communicating with and extending above said second post; and c) a plurality of rungs attached to and fixed between said first corresponding post and said second corresponding post.

5. The invention of claim 4 wherein said first member and said second member are fastened together to form an upside-down Y load sensitive pliant suspender, when said load is applied to said user supporting platform.

6. The invention of claim 5 further comprising an anchor for further stabilizing said user supporting platform.

7. The invention of claim 6 wherein said anchor is an elastomeric anchor.

8. The invention of claim 7 wherein said footing is adhered to said user supporting platform.

9. The invention of claim 7 wherein said footing further includes a plurality of segments raised upward from said user supporting platform.

10. A method of utilizing a personal stand, including a platform, for supporting a user's feet, comprising the steps of:

a) leaning a ladder against a substantially vertical stop such that a common span of a pair of posts of said ladder is sloped at an angle less than perpendicular, as measured from a top of said ladder to a bottom of said ladder;

b) mounting said ladder;

c) moving said personal stand up said ladder for a predetermined distance;

d) balancing on a rung of said ladder, until said personal stand is moored to said ladder;

e) creating a footing, incorporating said platform of said personal stand, for supporting said user's feet;

wherein said platform includes:

i) a first end communicating with a first rung of said ladder such that said first end's width traverses at least one-half said length of said first rung but less than an entire length of said first rung;

ii) an uppermost surface area greater than a pair of tracks of said user's feet;

iii) a section adapted for enhancing said user's traction;

iv) a depending collar, inferior to said uppermost surface area, at said first end for engaging said first rung; and v) a pair of apertures proximate said first end communicating with said first rung;

f) attaching a load sensitive pliant suspender to said platform;

wherein said load sensitive pliant suspender includes:

i) a first member attached to said platform parallel to said first rung; and ii) a second member coupled to said first member;

g) extending said second member of said load sensitive pliant suspender toward a second and higher rung relative to said first rung;

h) girding said second and higher rung with said load sensitive pliant suspender;

i) adjusting said load sensitive pliant suspender to where said footing is substantially horizontal;

j) clasping said second member of said load sensitive pliant suspender to yoke said second and higher rung;

k) standing on said platform such that said user's tracks contacts said personal stand; and l) transiently transforming said load sensitive pliant suspender into a rigid upside-down Y.

11. The invention of claim 10 further comprising the step of pinning said platform against said first rung of said ladder.

12. A personal stand for supporting a user, comprising:

a) a ladder, including:

i) a first post, wherein said first post further comprises:
A) a first foot for engaging a base; and
B) a first upper portion for resting against a substantially vertical stop;
ii) a second post parallel to said first post, wherein said second post further comprises:
A) a second foot for engaging said base; and
B) a second upper portion for resting against said substantially vertical stop;
such that a common span of said first post and said second post is sloped at an angle less than perpendicular; and
iii) a plurality of rungs attached to and fixed between said first post and said second post, wherein a length for each of said plurality of rungs is determined by an interposed distance between said first post and said second post;

b) a user supporting platform creating a footing for said user's feet, further comprising:
i) a first end communicating with a first rung of said ladder such that said first end's width traverses at least one-half said length of said first rung but less than an entire length of said first rung;
ii) an upper surface area greater than a bottom surface area of said user's feet, when said user is standing on said user supporting platform;
iii) a section adapted for enhancing said user's traction; and
iv) a skirt depending downward from an outer circumference of said user supporting platform;
wherein said skirt further includes:
A) a first opening proximate to and parallel said first end; and
B) a second opening parallel to said first end and opposite said first opening;
such that said skirt, said first opening and said second opening create a collar for engaging said first rung;

c) a load sensitive pliant suspender attached to a second end of said user supporting platform opposite said first end of said user supporting platform:
i) wherein said load sensitive pliant suspender is extended upward from said user supporting platform and toward a second and higher rung relative to said first rung; and
ii) wherein said load sensitive pliant suspender is girded about said second and higher rung such that as load is applied to said user supporting platform said load sensitive pliant suspender is transiently transformed into a rigid suspender, until said load is displaced from said user supporting platform; and d) a clasp
for securely yoking said load sensitive pliant suspender about said second and higher rung,
ii) wherein said clasp is connected to said load sensitive pliant suspender at a location between said upper surface area of said user supporting platform and said second and higher rung to selectively adjust said load sensitive pliant suspender such that said user supporting platform is substantially parallel to said base engaging said first post and said second post of said ladder.

13. The invention of claim 12 further comprising the step of anchoring said platform to a rung of said ladder lower than said first rung.

14. The invention of claim 12 wherein said load sensitive pliant suspender comprises:
i) a first member attached to said user supporting platform; and
ii) a second member fastened to said first member and coupled to said clasp.

15. The invention of claim 14, said personal stand further comprising:
i) an aperture proximate said first end of said user supporting platform; and
ii) a pin for securing said user supporting platform against said first rung.

16. The invention of claim 15 further comprising:
a) a first corresponding post communicating with and extending above said first post;
b) a second corresponding post communicating with and extending above said second post; and
c) a plurality of rungs attached to and fixed between said first corresponding post and said second corresponding post.

17. The invention of claim 16 wherein said first member and said second member are fastened together to form an upside-down Y load sensitive pliant suspender.

18. The invention of claim 17 further comprising an anchor for further stabilizing said user supporting platform.

19. The invention of claim 18 wherein said footing is adhered to said user supporting platform.

20. The invention of claim 18 wherein said footing further includes a plurality of segments raised upward from said user supporting platform.

* * * * *